US006481687B2

(12) United States Patent
Najmi

(10) Patent No.: US 6,481,687 B2
(45) Date of Patent: Nov. 19, 2002

(54) PAPER HOLDER

(75) Inventor: Boman K Najmi, Crofton, MD (US)

(73) Assignee: BHS International, Inc., Crofton, MD (US)

( * ) Notice: Subject to any disclaimer, the term of this patent is extended or adjusted under 35 U.S.C. 154(b) by 0 days.

(21) Appl. No.: 09/797,742

(22) Filed: Mar. 5, 2001

(65) Prior Publication Data

US 2002/0121584 A1 Sep. 5, 2002

(51) Int. Cl.[7] ..... A47B 97/02

(52) U.S. Cl. ..... 248/452; 248/450; 248/451; 248/316.5; 24/67 R; 24/67.11

(58) Field of Search ..... 248/450, 451, 248/452, 444, 444.1, 447, 458, 316.5, 316.7, 292.12; 24/67 R, 67.11, 67.3

(56) References Cited

U.S. PATENT DOCUMENTS

| | | | | | |
|---|---|---|---|---|---|
| 587,775 | A | * | 8/1897 | Yockel | |
| 632,155 | A | * | 8/1899 | Smith | |
| 1,078,805 | A | * | 11/1913 | Schahl | |
| 1,368,868 | A | * | 2/1921 | Wertman | |
| 4,991,268 | A | * | 2/1991 | Ho | 24/67.3 |
| 5,079,808 | A | * | 1/1992 | Brown | 24/67.7 |
| D333,155 | S | * | 2/1993 | Hiromori | D19/65 |
| 5,667,183 | A | * | 9/1997 | Hiromori | 248/451 |
| 5,845,889 | A | * | 12/1998 | Suzuki | 248/451 |
| 6,059,249 | A | * | 5/2000 | Scatterday | 248/450 |
| 6,267,346 | B1 | * | 7/2001 | Dill et al. | 248/473 |

* cited by examiner

*Primary Examiner*—Leslie A. Braun
*Assistant Examiner*—Steven Marsh
(74) *Attorney, Agent, or Firm*—Rabin & Berdo, P.C.

(57) ABSTRACT

A paper holder (100) comprising a base (10), a pair of front and rear jaws (21 & 22) provided on the base (10) for gripping a sheet of document by its lower end to holder generally upright. A hinge (30) connects the front jaw (21) to the base (10) for pivotal movement relative to the rear jaw (22) for opening and closing the jaws (21 & 22). A spring (35) resiliently biasses the front jaw (21) towards the rear jaw (22). The front jaw (21) has an upper surface (23A) extending over and above the base (10) for pressing by a user to pivot the front jaw (21) away from the rear jaw (22) against the action of the spring (35). The jaws (21 & 22) have respective inner surfaces (25A & 26A) for gripping, which are of comparable size as each other and are curved in a complementary manner.

7 Claims, 4 Drawing Sheets

PAPER HOLDER

BACKGROUND OF THE INVENTION

Document or paper holders are generally known. In a typical construction, the holder has a base and a pair of front and rear jaws provided on the base for gripping a sheet of the document by its lower end to hold it generally upright. The front jaw is spring-loaded and is hinged to the base for pivotal movement to open and close the jaws. As is known, the front jaw is comparatively much smaller than the rear jaw and is movable by means of a press knob provided on the base. The press knob is inconvenient to operate, and the grip provided by the holder is found to be inadequate in terms of strength.

The invention seeks to mitigate or at least alleviate such disadvantages by providing an improved paper holder.

SUMMARY OF THE INVENTION

According to a first aspect of the invention, there is provided a paper holder comprising a base, a pair of front and rear jaws provided on the base for gripping a sheet of document by its lower end to holder generally upright, a hinge connecting the front jaw to the base for pivotal movement relative to the rear jaw for opening and closing the jaws, and a spring resiliently biassing the front jaw towards the rear jaw, wherein the front jaw has an upper surface extending over and above the base for pressing by a user to pivot the front jaw away from the rear jaw against the action of the spring.

Preferably, the upper surface of the front jaw has a size that is at least half of the size of the base when viewed from above.

Preferably, the front and rear jaws have respective upper surfaces which, upon closing of the jaws, join together to form a convex combined surface of a size comparable to that of the base when viewed from above.

According to a second aspect of the invention, there is provided a paper holder comprising a base, a pair of front and rear jaws provided on the base for gripping a sheet of document by its lower end to holder generally upright, a hinge connecting the front jaw to the base for pivotal movement relative to the rear jaw, and a spring resiliently biassing the front jaw towards the rear jaw, wherein the jaws have respective inner surfaces for gripping, said surfaces being of comparable size, at least in terms of width, as each other and being curved in a complementary manner.

Preferably, the gripping surfaces of the jaws have substantially the same size as each other.

In either aspect, it is preferred that the rear jaw is connected by another hinge for pivotal movement relative to the front jaw.

More preferably, said another hinge connects the rear jaw to the base.

In a preferred embodiment, the two hinges are provided with respective gears in mesh with each other such that the two jaws are: simultaneously pivotable in opposite directions.

Preferably, the hinge has two parts, and a low viscosity fluid is applied between the hinge parts to dampen the movement of the front jaw.

It is preferred that the hinge is in the form of a rod supported at opposite ends by the base for turning about its axis, in each of which ends a said spring in the form of a torsional coil spring is provided.

Preferably, the two hinges are in the form of respective rods which extend parallel to and side-by-side with each other and are arranged to turn about their respective axes in opposite directions.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
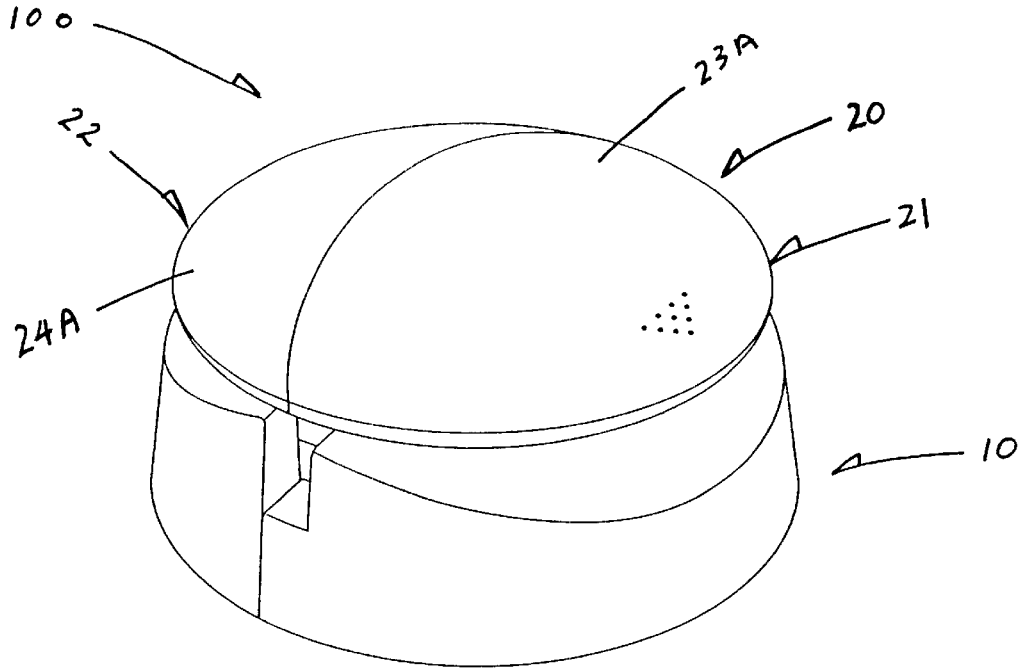
FIG. 1 is a top perspective view of an embodiment of a paper holder in accordance with the invention, said holder having a pair of top jaws shown in a closed condition.
Figure 2:
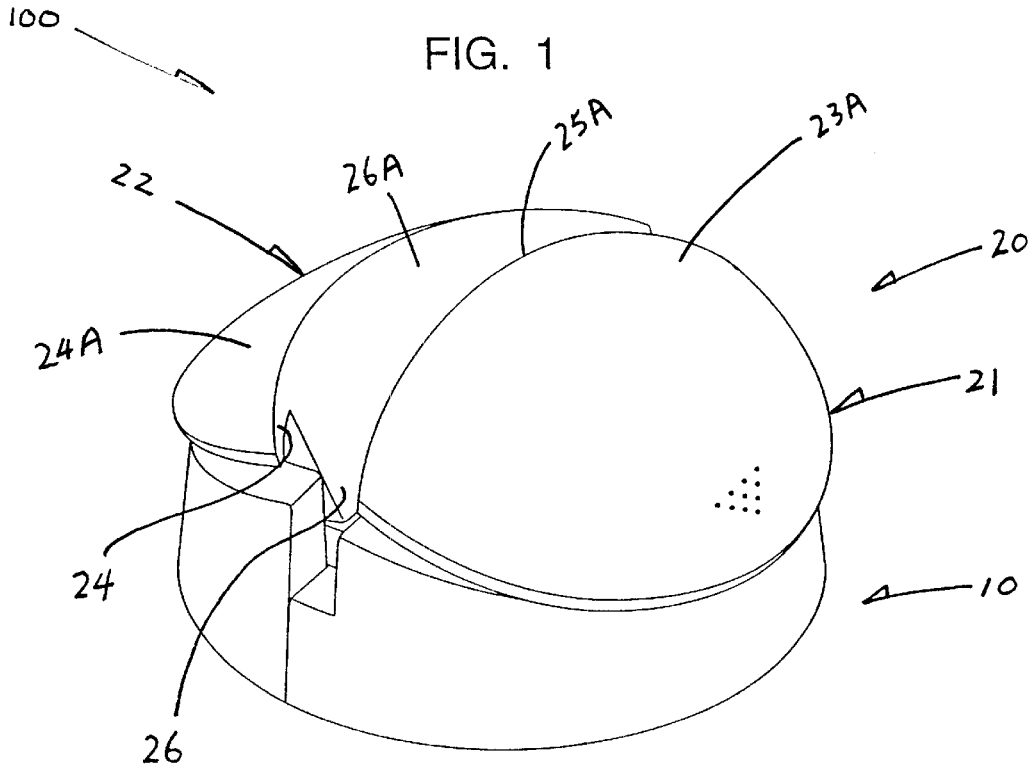
FIG. 2 is a top perspective view corresponding to FIG. 1, showing the jaws on an open condition.
Figure 5:
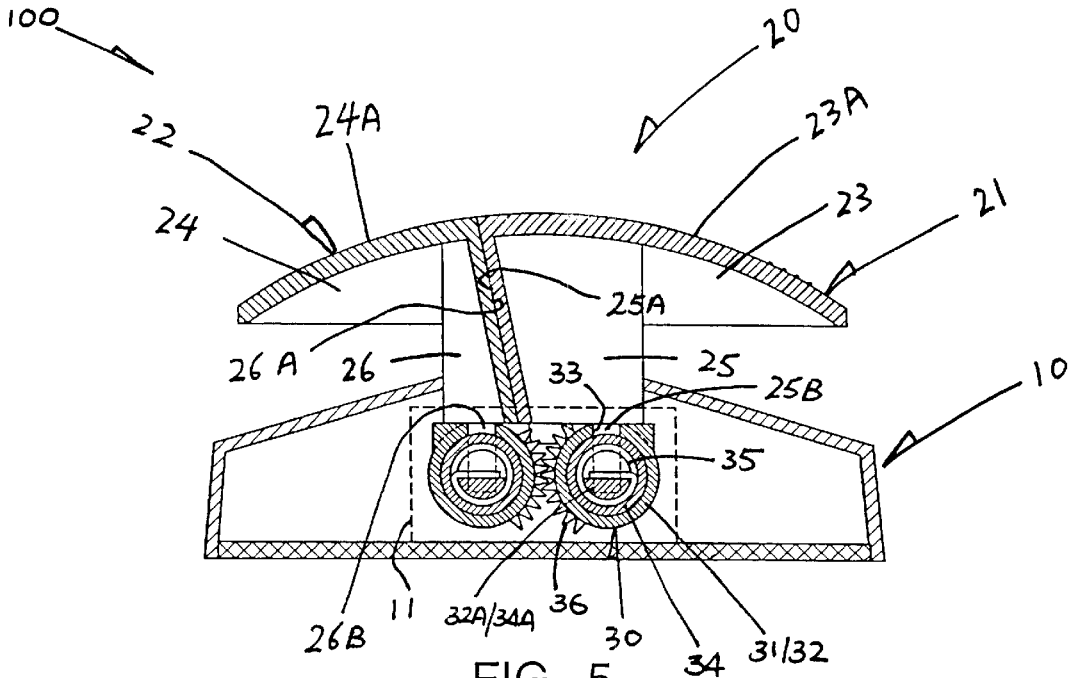
FIG. 5 is a cross-sectional side view of the paper holder of FIG. 1.
Figure 6:
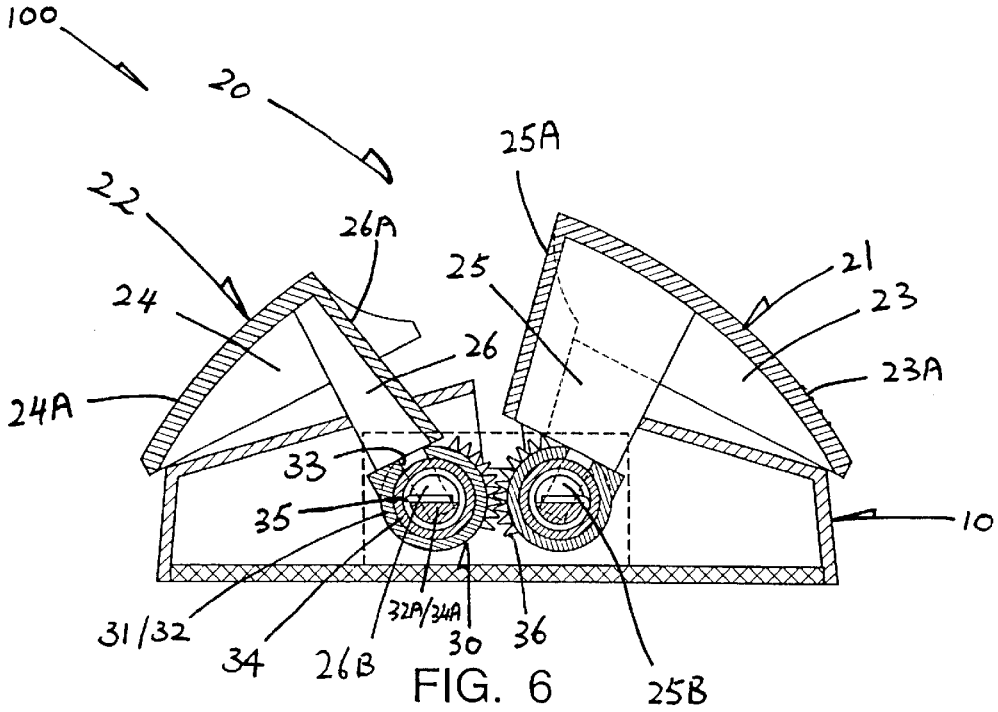
FIG. 6 is a cross-sectional side view of the paper holder of FIG. 2.
Figure 7:
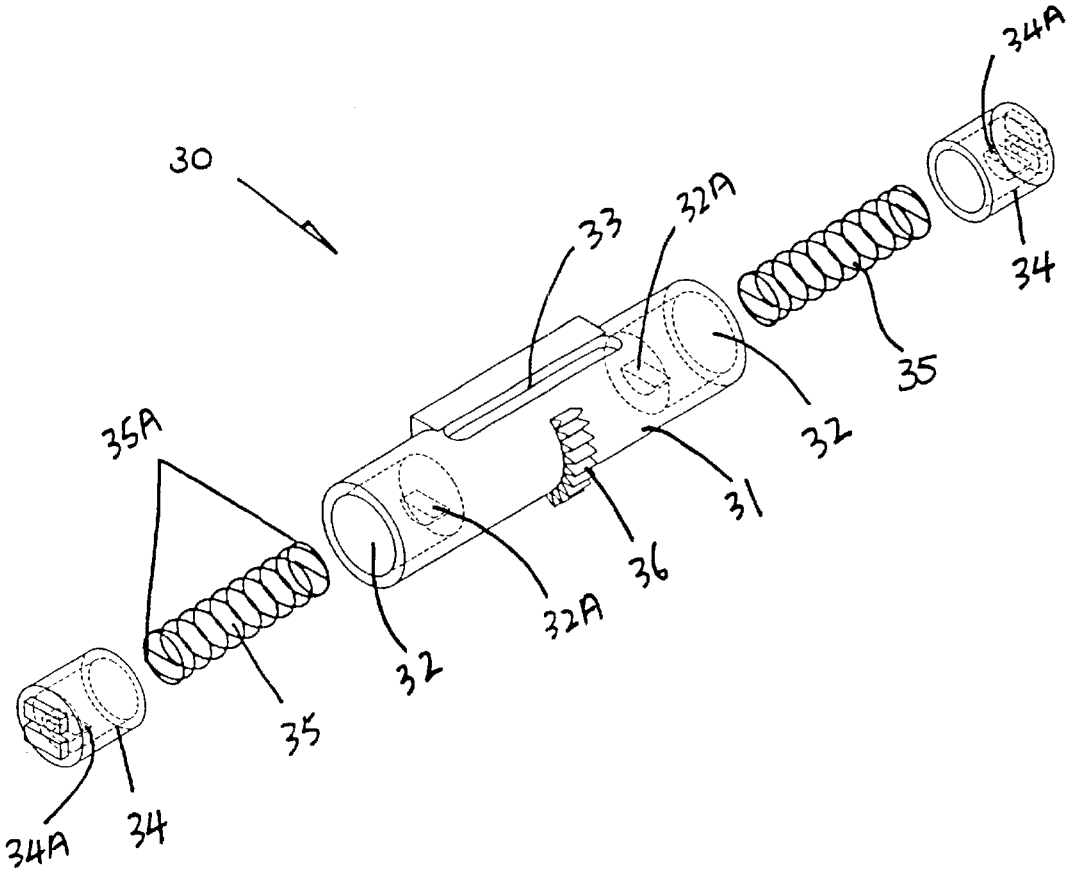
FIG. 7 is an exploded perspective view of a spring-loaded hinge rod of the paper holder of FIG. 1 for connecting each jaw.

Referring to the drawings, there is shown a paper holder 100 embodying the invention for holding a sheet of paper or plastic document generally upright. The holder 100 comprises a circular base 10 for resting on a horizontal surface, such as a desktop, and an openable top 20 formed by a pair of front and rear jaws 21 and 22 on the base 10. The holder 100 includes a pair of horizontal hinge rods 30 which extend parallel to and side-by-side with each other within the base 10. The hinge rods 30 support the jaws 21 and 22 respectively for simultaneous pivotal movement in opposite directions close against each other, thereby resulting in a closed condition of the top 20 (FIGS. 1 and 5), and in reversed opposite directions apart from each other, thereby resulting in an open condition of the top 20 (FIGS. 2 and 6).

Each jaw 21/22 has a relatively thin upper body 23/24 extending over and above the base 10 and a stem 25/26 depending from the body 23/24. The bodies 23 and 24 have respective convex uppermost surfaces 23A and 24A which, in the closed condition of the top 20, join together to form a circular part-spherical combined surface that is comparable to the size of the base 10 or almost as large or wide as the base 10 when viewed from above. The stems 25 and 26 have respective inner surfaces 25A and 26A for gripping a document sheet inserted between the jaws 21 and 22. The surfaces 25A and 26A are of comparable size or substantially the same size as each other and are curved in a complementary manner. In the closed condition of the top 20, the surfaces 25A and 26A lie in close contact against each other to form an arcuate bite for gripping the document sheet by its lower end. The bite formed between the two surfaces 25A and 26A is concave on the side of the front jaw 21 or convex on the side of the rear jaw 22, and extends upwards or downwards along a direction that leans slightly rearwards. The bottom end of each stem 25/26 is reduced into a respective tab 25B/26B.

Figure 3:
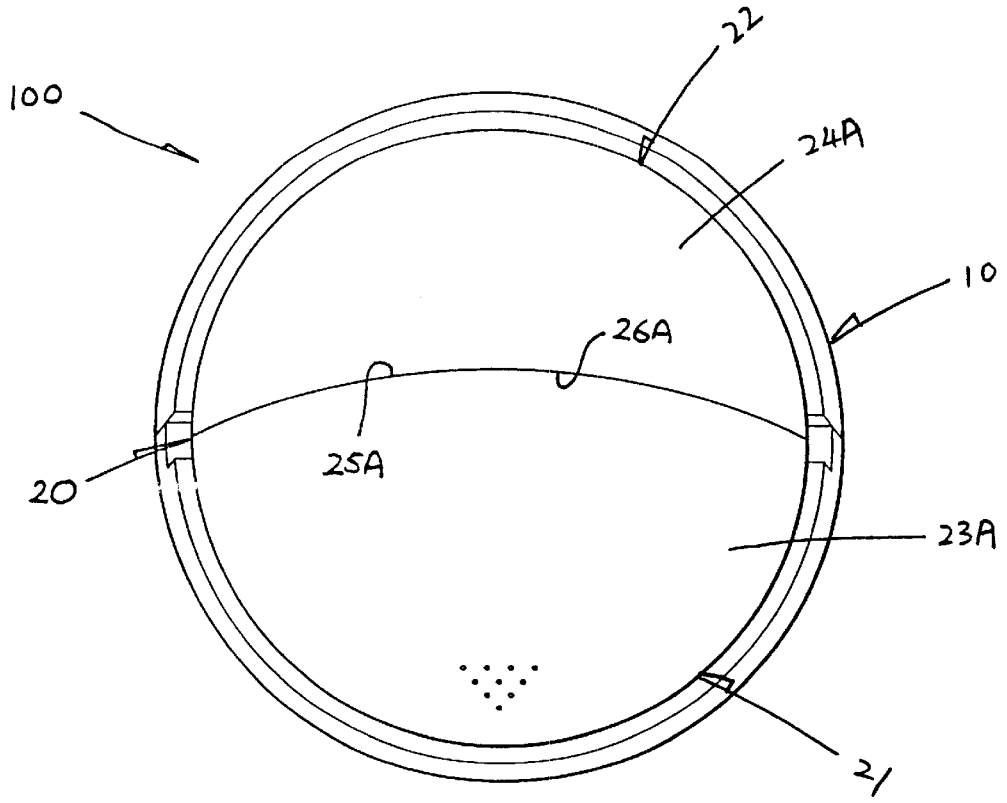
FIG. 3 is a top plan view of the paper holder of FIG. 1.
Figure 4:
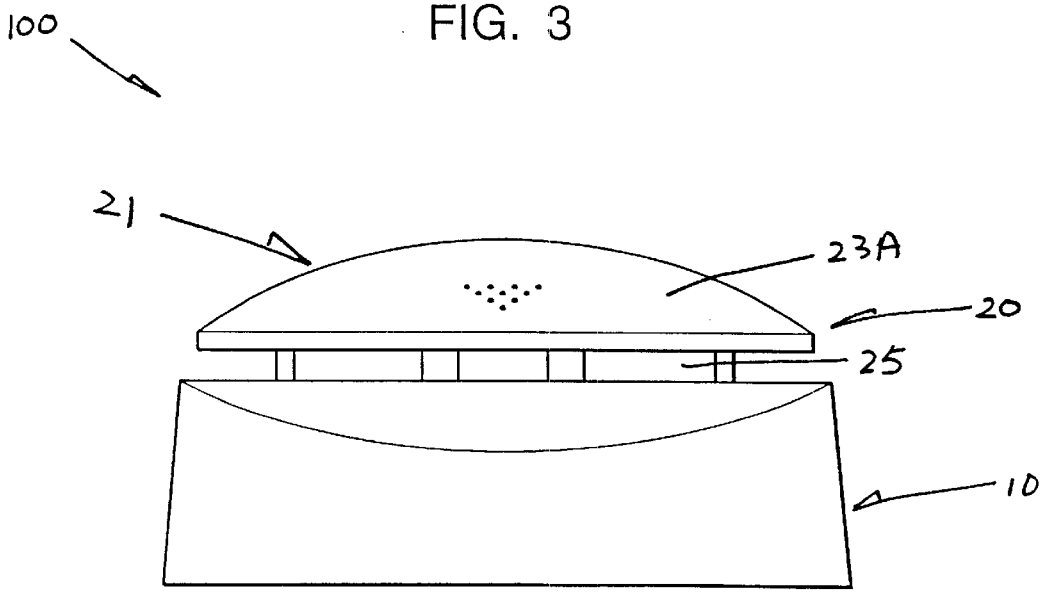
FIG. 4 is a front side view of the paper holder of FIG. 1.

The front and rear jaws 21 and 22 are comparable in terms of size. By reason of the inner surfaces 25A and 26A between the jaws 21 and 22 being curved in the manner as described above, the upper surface 23A of the front jaw 21 has a size that is at least half or larger than the size of the base 10 when viewed from above (FIG. 3).

Each hinge rod 30 has a tubular body 31 having left and right ends 32 and including a slot 33 that extends longitudinally along the upper side of the body's middle section. The slot 33 serves to receive the bottom tab 25B/26B of the respective front/rear jaw 21/22, whereby the jaw 21/22 is supported by the hinge rod 30.

Each end 32 of the hinge rod body 31 is hollow and formed internally with an axially extending protrusion 32A. The hinge rod 30 is supported for turning about its axis by having the ends 32 Of its body 31 co-axially and rotatably disposed over respective cylindrical plugs 34 which are fixed on respective internal walls 11 of the base 10. Each plug 34 is hollow and formed internally with an axially extending protrusion 34A.

Each plug 34 is substantially fully enclosed within the respective end 32 of the hinge rod body 31. A torsional coil spring 35 is held captive within each plug 34 and in turn within the respective hinge rod end 32. Each spring 35 is anchored at its opposite ends 35A by the protrusions 32A and 34A and is torsionally loaded in the same direction, such that the hinge rod 30 concerned is resiliently biassed by the springs 35 at its opposite ends to turn in one direction relative to the plugs 34.

A thin layer of low viscosity fluid is applied to the interface between each plug 34 and the respective end 32 of the hinge rod body 31, such that the hinge rods 30 are dampened to turn slowly.

A series of gear teeth 36 is provided on each hinge rod body 31 at mid-length, which extends partially round the side of the body 31 facing the body 31 of the other hinge rod 30. The two series of teeth 36 are in mesh with each other, such that the pair of hinge rods 30 are rotatable simultaneously to a limited extent in opposite directions. The springs 35 between the two hinge rods 30 are pre-loaded in opposite directions, such that the front and rear jaws 21 and 22 are resiliently biassed to pivot against each other, whereby the top 20 is normally closed.

The top 20 may be opened by a user pressing the front jaw 21 (or the rear jaw 22 or both) downwards, at its convex uppermost surfaces 23A. By reason of the relative large size of the surface 23A (or the surface 24A of the rear jaw 22), the top 20 can conveniently and easily be opened. Upon release, the front jaw 21 together with the rear jaw 22 will pivot back upwards and close the bite automatically, thereby gripping a document sheet inserted therebetween.

The slow closing movement of the jaws 21 and 22 is not only visually pleasing but can also allow for adjustment of the position of the document sheet, or even insertion of the document sheet, subsequent to the release of the jaw(s) 21/22 and prior to the final closing of the bite.

By reason of the gripping surfaces 25A and 26A being substantially the same size and as large or wide as possible within the physical size constraint of the base 10, the gripping strength or area (width) as provided by the jaws 21 and 22 is maximised, which ensures reliable gripping and stable holdering of the document sheet.

The invention has been given by way of example only, and various modifications of and/or alterations to the described embodiment may be made by persons skilled in the art without departing from the scope of the invention as specified in the appended claims.

What is claimed is:

1. A paper holder, comprising:

a base;

a front jaw and a rear jaw provided on the base for gripping a lower end of a sheet of document to hold the sheet generally upright;

a hinge connecting the front jaw to the base for pivotal movement relative to the rear jaw for opening and closing the jaws; and a plurality of springs resiliently biasing the front jaw towards the rear jaw, wherein the front jaw has an upper surface extending over and above the base for pressing by a user to pivot the front jaw away from the rear jaw against the action of the springs; and wherein the hinge is in the form of a rod supported at opposite ends by the base for turning about its axis, wherein said springs are torsional coil springs, and wherein each of the ends of the rod has one of said torsional coil springs provided therein.

2. The paper holder as claimed in claim 1, wherein the upper surface of the front jaw has a size that is at least half of the size of the base when viewed from above.

3. the paper holder as claimed in claim 1, wherein the front and rear jaws have respective upper surfaces which, upon closing of the jaws, join together to form a convex combined surface of a size comparable to that of the base when viewed from above.

4. The paper holder as claimed in claim 3, wherein said second hinge connects the rear jaw to the base.

5. A paper holder, comprising:

a base;

a front jaw and a rear jaw provided on the base for gripping a lower end of a sheet of document to hold the sheet generally upright;

a first hinge connecting the front jaw to the base for pivotal movement relative to the rear jaw;

a second hinge connected to the rear jaw for pivotal movement relative to the front jaw; and a spring resiliently biasing the front jaw towards the rear jaw, wherein the front jaw has an upper surface extending over and above the base for pressing by a user to pivot the front jaw away from the rear jaw against the action of the spring; and wherein the two hinges are provided with respective gears in mesh with each other such that the two jaws are simultaneously pivotable in opposite directions.

6. A paper holder, comprising:

a base;

a front jaw and a rear jaw provided on the base for gripping a lower end of a sheet of document to hold the sheet generally upright;

a hinge connecting the front jaw to the base for pivotal movement relative to the rear jaw; and a spring resiliently biasing the front jaw towards the rear jaw, wherein the front jaw has an upper surface extending over and above the base for pressing by a user to pivot the front jaw away from the rear jaw against the action of the spring; and wherein the hinge has two parts, and a low viscosity fluid is applied between the hinge parts to dampen the movement of the front jaw.

7. The paper holder as claimed in claim 5, wherein the two hinges are in the form of respective rods which extend parallel to and side-by-side with each other and are arranged to turn about their respective axes in opposite directions.

* * * * *